US006581491B2

(12) United States Patent
Brock et al.

(10) Patent No.: US 6,581,491 B2
(45) Date of Patent: Jun. 24, 2003

(54) PEDAL WITH TONGUED CONNECTION FOR IMPROVED TORSIONAL STRENGTH

(75) Inventors: Robert D. Brock, Grand Haven, MI (US); William C. Staker, Spring Lake, MI (US)

(73) Assignee: Grand Haven Stamped Products, division of JSJ Corporation, Grand Haven, MI (US)

( * ) Notice: Subject to any disclaimer, the term of this patent is extended or adjusted under 35 U.S.C. 154(b) by 49 days.

(21) Appl. No.: 09/782,563

(22) Filed: Feb. 13, 2001

(65) Prior Publication Data

US 2002/0108464 A1 Aug. 15, 2002

(51) Int. Cl.[7] ..... G05G 1/14
(52) U.S. Cl. ..... 74/512
(58) Field of Search ..... 74/512, 513, 560, 74/562

(56) References Cited

U.S. PATENT DOCUMENTS

| | | | | | |
|---|---|---|---|---|---|
| 311,754 | A | * | 2/1885 | Haynes | 74/562 |
| 1,328,400 | A | * | 1/1920 | Reich | 74/562 |
| 1,425,413 | A | * | 8/1922 | Page | 403/103 |
| 2,760,739 | A | | 8/1956 | Reichert | 244/83 |
| 2,908,183 | A | | 10/1959 | Giovanni | 74/513 |
| 3,129,605 | A | | 4/1964 | Bonnell, Jr. et al. | 74/501 |
| 3,151,499 | A | | 10/1964 | Roe | 74/560 |
| 3,242,763 | A | | 3/1966 | Buchwald | 74/560 |
| 3,282,125 | A | | 11/1966 | Dully | 74/560 |
| 3,301,088 | A | | 1/1967 | White | 74/560 |
| 3,576,302 | A | | 4/1971 | Palfreyman | 244/83 |
| 3,643,524 | A | | 2/1972 | Herring | 74/512 |
| 3,643,525 | A | | 2/1972 | Gibas | 74/512 |
| 3,691,868 | A | | 9/1972 | Smith | 74/512 |
| 3,754,480 | A | * | 8/1973 | Bodnar et al. | 74/512 |
| 3,807,253 | A | * | 4/1974 | Belzile et al. | 74/512 |
| 3,828,625 | A | | 8/1974 | Bruhn, Jr. | 74/512 |
| 3,975,972 | A | | 8/1976 | Muhleck | 74/560 |
| 4,353,430 | A | | 10/1982 | Sjöqvist et al. | 180/90 |
| 4,470,570 | A | | 9/1984 | Sakurai et al. | 244/235 |
| 4,499,963 | A | | 2/1985 | Liston | 180/90.6 |

(List continued on next page.)

*Primary Examiner*—Thomas R. Hannon
*Assistant Examiner*—Vicky A. Johnson
(74) *Attorney, Agent, or Firm*—Price, Heneveld, Cooper, DeWitt & Litton

(57) ABSTRACT

A pedal construction includes an adjustable pedal subassembly having a lower pedal member adjustably supported on an upper pedal member by an adjustment device. The lower pedal member includes a pedal lever and a lever mount including abutting mounting sections forming a fixed joint. The mounting section of the lever mount has a channel with sharp edges and the mounting section of the lever has a ridge interference fit into the channel. The sharp edges shave marginal material from sides of the ridge when the ridge is forced into the channel, but the ridge has depressions adjacent its bottom that receive the shaved marginal material when the ridge is forced into the channel. Fasteners extend through the ridge and channel to hold the assembly together, with the ridge and channel interface forming a primary mechanical structure providing torsional strength to the joint.

28 Claims, 2 Drawing Sheets

U.S. PATENT DOCUMENTS

| | | | | |
|---|---|---|---|---|
| 4,640,248 | A | | 2/1987 | Stoltman ..... 423/399 |
| 4,683,977 | A | | 8/1987 | Salmon ..... 180/334 |
| 4,870,871 | A | | 10/1989 | Ivan ..... 74/513 |
| 4,875,385 | A | | 10/1989 | Sitrin ..... 74/512 |
| 4,944,269 | A | | 7/1990 | Imoehl ..... 123/399 |
| 4,958,607 | A | | 9/1990 | Lundberg ..... 123/399 |
| 4,969,437 | A | | 11/1990 | Kolb ..... 123/399 |
| 4,986,238 | A | | 1/1991 | Terazawa ..... 123/361 |
| 4,989,474 | A | | 2/1991 | Cicotte et al. ..... 74/512 |
| 5,010,782 | A | | 4/1991 | Asano et al. ..... 74/512 |
| 5,056,742 | A | | 10/1991 | Sakurai ..... 244/235 |
| 5,078,024 | A | | 1/1992 | Cicotte et al. ..... 74/512 |
| 5,086,663 | A | | 2/1992 | Asano et al. ..... 74/512 |
| 5,172,606 | A | | 12/1992 | Dzioba et al. ..... 74/512 |
| 5,261,143 | A | | 11/1993 | Toth ..... 15/210.1 |
| 5,309,361 | A | | 5/1994 | Drott et al. ..... 364/424.1 |
| 5,351,573 | A | | 10/1994 | Cicotte ..... 74/512 |
| 5,460,061 | A | | 10/1995 | Redding et al. ..... 74/512 |
| 5,632,183 | A | | 5/1997 | Rixon et al. ..... 74/512 |
| 5,676,220 | A | | 10/1997 | Dapsi et al. ..... 180/334 |
| 5,697,260 | A | | 12/1997 | Rixon et al. ..... 74/514 |
| 5,722,302 | A | * | 3/1998 | Rixon et al. ..... 74/512 |
| 5,771,752 | A | | 6/1998 | Cicotte ..... 74/512 |
| 5,819,593 | A | | 10/1998 | Rixon et al. ..... 74/514 |
| 5,823,064 | A | | 10/1998 | Cicotte ..... 74/512 |
| 5,839,326 | A | | 11/1998 | Song ..... 74/562 |
| 5,927,154 | A | | 7/1999 | Elton et al. ..... 74/512 |
| 5,937,707 | A | | 8/1999 | Rixon et al. ..... 74/560 |
| 5,964,125 | A | | 10/1999 | Rixon et al. ..... 74/514 |
| 6,109,241 | A | | 8/2000 | Engelgau ..... 123/399 |
| 6,173,625 | B1 | | 1/2001 | McFarlane et al. ..... 74/512 |
| 6,178,847 | B1 | | 1/2001 | Willemsen et al. ..... 74/512 |
| 6,205,883 | B1 | | 3/2001 | Bortolon ..... 74/512 |
| 6,247,381 | B1 | | 6/2001 | Toelke et al. ..... 74/512 |
| 6,293,584 | B1 | | 9/2001 | Levine ..... 280/735 |
| 6,321,617 | B1 | * | 11/2001 | Schwyn ..... 74/512 |
| 6,352,007 | B1 | * | 3/2002 | Zhang et al. ..... 74/512 |

* cited by examiner

PEDAL WITH TONGUED CONNECTION FOR IMPROVED TORSIONAL STRENGTH

BACKGROUND OF INVENTION

The present invention concerns foot pedals and levers mounted for strength and durability, and more particularly concerns vehicle pedals, such as brake pedals, having a fixed joint configured for high torsional strength and long term durability.

Vehicle brake pedals undergo a high number of low-stress cycles of use during normal braking, and further periodically undergo a significant number of high stress incidents, such as during emergency braking. Historically, loose joints and wear was not a problem, since stiff brake pedal levers were simply pivoted to a durable vehicle-attached bracket by a high-strength lubricious pivot pin. However, adjustable pedal systems have introduced additional joints and points of potential durability problems, as discussed below.

Specifically, many vehicle manufacturers are now considering adjustable foot pedals, since there are advantages of improved air bag safety and lower cost to adjusting the location of pedals instead of moving a steering column, vehicle seat, and/or occupant. However, this has introduced joints and components into the brake pedal system that were not previously present. For example, in an adjustable pedal system where a linear adjustment device is introduced between the pedal lever and the pedal pivot, the adjustment device must be made of a first track component attached to the pedal lever and a second track component attached to the pedal pivot, all of which must be attached and adjustably interconnected in a manner that does not become loose over time under either low-cycle high stress or high-cycle intermediate stress. Further, all components in the system must provide consistently high torsional strength, despite dimensional and other manufacturing variations. At the same time, the joints must preferably be simple, low cost, reliable, effective, robust, and readily manufacturable.

Accordingly, an apparatus solving the aforementioned problems and having the aforementioned advantages is desired.

SUMMARY OF THE INVENTION

In one aspect of the present invention, an article includes a foot pedal lever and a lever mount including abutting mounting sections forming a fixed joint. One section has a channel and the other section has a ridge interference fit into the channel. One of the ridge and channel has sharp edges that shave marginal material from sides of the other of the ridge and channel when the ridge is forced into the channel, but at least one of the mounting sections has depressions positioned to receive the shaved marginal material when the ridge is forced into the channel so that the ridge can be fully seated in the channel. At least one fastener holds the ridge in the channel, with the ridge and channel defining a plane and forming a primary mechanical structure providing torsional strength in the plane.

In another aspect of the present invention, a torsionally strong joint is provided for connecting a vehicle pedal lever and a lever mount, where the lever and the lever mount include abutting mounting sections. The joint includes one mounting section having a channel and the other mounting section having a ridge interference fit into the channel. One of the channel and the ridge has sharp edges that shave marginal material from sides of the other of the channel and the ridge when the ridge is forced into the channel, but one of the channel and the ridge also has depressions positioned to receive the shaved marginal material when the ridge is forced into the channel. At least one fastener holds the ridge in the channel, with the ridge and channel defining a plane and forming a primary mechanical structure providing torsional strength to the joint in the plane.

In yet another aspect of the present invention, a pedal apparatus includes a support, and a pedal subassembly. The pedal assembly includes an upper pedal member pivoted to the support, a lower pedal member, and an adjustment device adjustably supporting the lower pedal member on the upper pedal member for translational adjustment. The lower pedal member includes a pedal lever and a lever mount with abutting mounting sections forming a torsionally-strong fixed joint, with the mounting section of the lever mount having a channel and the mounting section of the lever having a ridge interference fit into the channel. At least one fastener holds the ridge in the channel with the ridge and channel defining a plane and forming a primary mechanical structure providing torsional strength to the joint in the plane.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
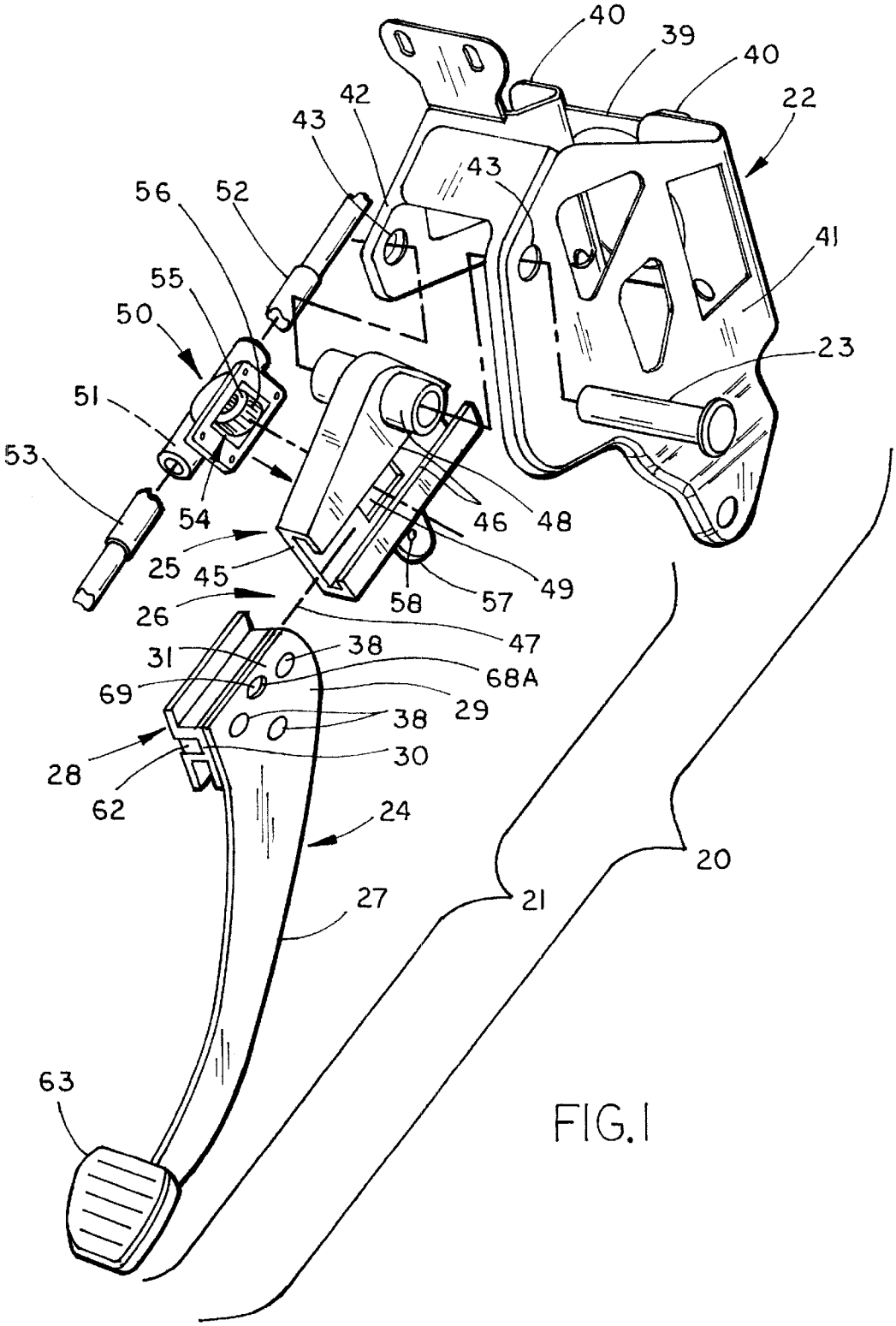
FIG. 1 is an exploded perspective view of a pedal construction embodying the present invention.

A pedal construction 20 (FIG. 1) includes an adjustable pedal subassembly 21 pivoted to a bracket support 22 by a pivot pin 23. The pedal subassembly 21 has a lower pedal member 24 adjustably supported on an upper pedal member 25 by an adjustment device 26. The lower pedal member 24 includes a pedal lever 27 and a lever mount 28 including abutting mounting sections 29 and 30 forming a torsionally-strong fixed joint 31. Specifically, the mounting section 30 of the lever mount 28 has a ridge 34 and the mounting section 29 of the pedal lever 27 has a channel 32 with sharp edges 33 interference fit into the channel 32. The sharp edges 33 shave marginal material 35 from sides 36 of the ridge 34 when the ridge 34 is forced into the channel 32. The ridge 34 has depressions 37 adjacent its bottom that receive the shaved marginal material 35 when the ridge 34 is forced into the channel 32, 50 that the marginal material 35 does not prevent a tight fit. Fasteners 38 extend through the ridge 34 and channel 32 to hold the joint 31 together with the ridge 34 and channel 32 interface forming a primary mechanical structure providing torsional strength to the joint 31.

Bracket support 22 (FIG. 1) includes a bottom 39 with apertured attachment flanges 40 shaped to engage and be attached to a vehicle floor pan or firewall. Side flanges 41 and 42 extend from the bottom 39, and include aligned holes 43 shaped to receive pivot pin 23. The side flanges 41 and 42 are shaped to provide support to the pivot pin 23, and further include apertures to minimize weight.

The upper pedal member 25 (FIG. 1) is cast and includes a body 45 with two inward L-shaped flanges 46 defining a linear track along direction 47. A transverse pivot tube/spacer 48 extends from a top of the body 45, and is positioned to fit between the side flanges 41 and 42 and to receive the pivot pin 23. A window 49 is formed in the body 45, and a gear housing 50 is attached to a back of the body 45. A worm gear 51 is positioned in the housing 50, and includes a first end attached to a drive cable 52 (driven by a 12 v DC motor for example) and a second end attached to a secondary driven cable 53 (such as for concurrently driving a second adjustable pedal arrangement). A gear member 54 is positioned in the housing 50, and includes a first gear 55 operably engaging the worm gear 51, and a second gear 56 that extends through the window 49. A down flange 57 extends downwardly from the body 45, and includes a connector 58 configured for connection to a push rod for operating a master brake cylinder when the brake pedal subassembly 21 is depressed.

Figure 2:
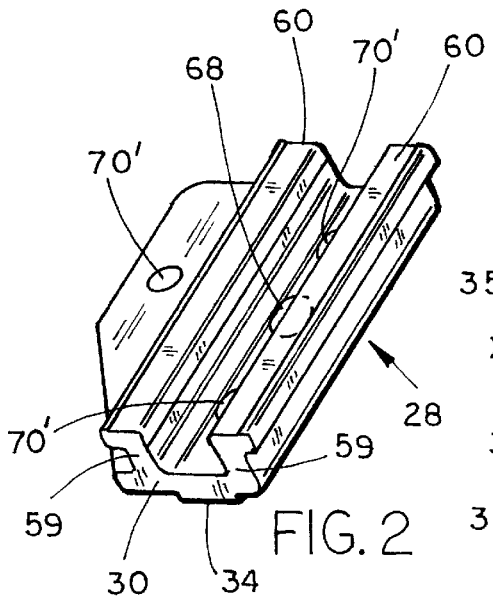
FIG. 2 is a perspective view of the lever mount shown in FIG. 1.

The lever mount 28 (FIG. 2) is hat-shaped, and includes a center wall which is flat and forms the mounting section 30, sidewalls 59, and outward walls 60. The outward walls 60 receive molded shoes or bushings 61 that slidably engage L-shaped flanges 46 on the member 25 for movement along direction 47. A rack 62 (FIG. 1) is attached between the sidewalls 59, and includes teeth 62' that operably mateably engage the teeth of the second gear 56, so that the lever mount 28 is moved along the track of body 45 as the gear member 54 is rotated.

Figure 4:
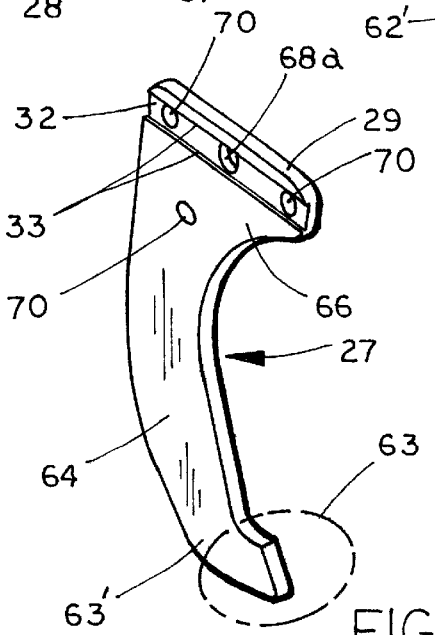
FIG. 4 is a perspective view of the pedal lever shown in FIG. 1.

The pedal lever 27 (FIG. 4) is vertically elongated, and includes a bottom end 63' supporting a foot pad 63, a midsection 64 that is arch-shaped for optimally locating the foot pad 63 in a vehicle, and a top end forming the mounting section 29.

Figure 6:
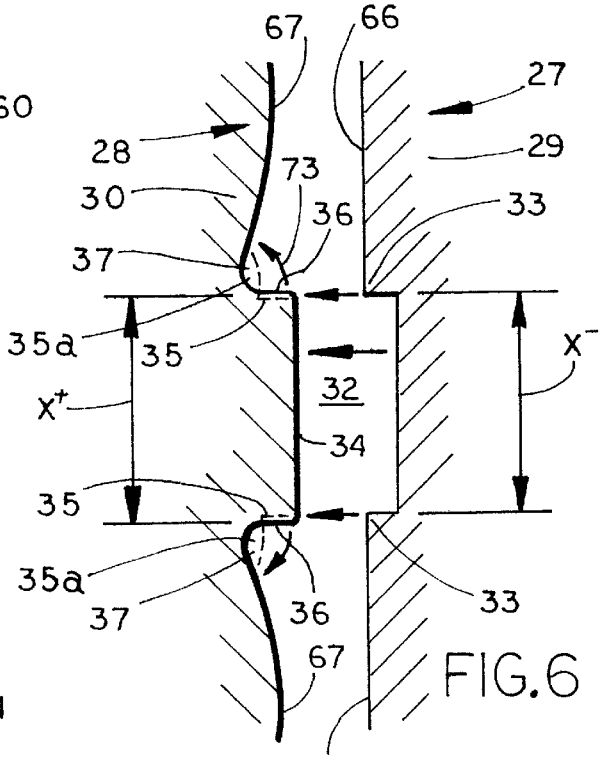
FIG. 6 is an enlarged exploded view of the ridge to channel interconnection.
Figure 3:
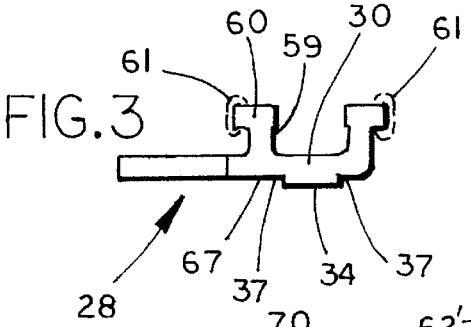
FIG. 3 is an end view of the lever mount of FIG. 2.
Figure 5:
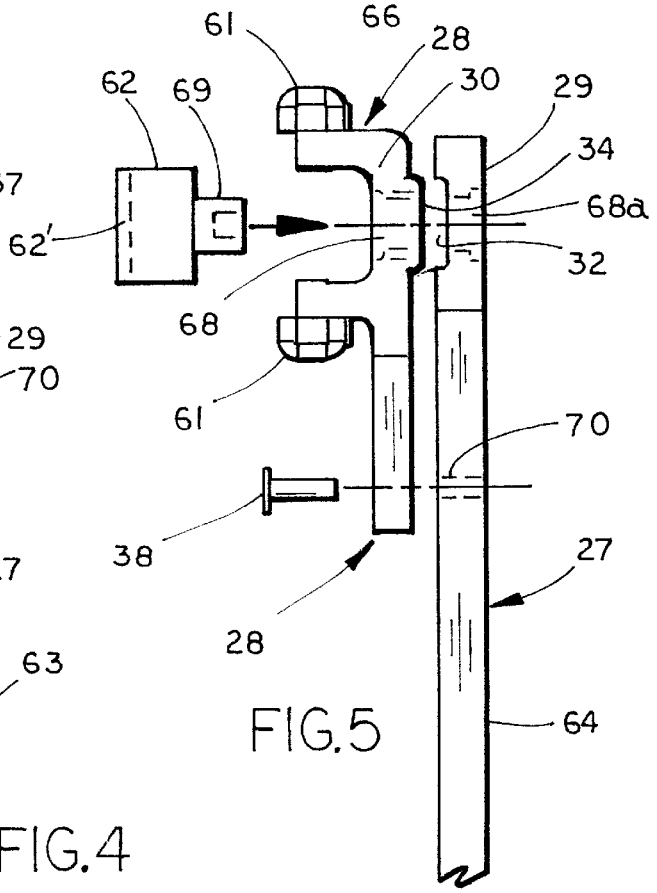
FIG. 5 is an exploded side view of the pedal lever attached to the lever mount.

The mounting sections 29 and 30 (FIG. 6) include flat surfaces 66 and 67, with the channel 32 and the ridge 34 being defined in the flat surfaces 66 and 67, respectively. (It is contemplated that the locations of the ridge and channel could be reversed on the mounting sections 29 and 30, if desired). Holes 68, 70 and 70' (FIG. 4) are formed in the mounting sections 29 and 30, such as in a center of the track of body 45, and rivets or locator pins are positioned in the holes as the mounting sections 29 and 30 are forced together, thus accurately locating and guiding the two mounting sections together. More specifically, three holes 70 and mating holes 70' are formed in the mounting sections 29 and 30, respectively, and rivets 38 or other fasteners are extended through the holes 70 and 70' for mechanically attaching the mounting sections 29 and 30 firmly together. Notably, the rivets 38 help hold the mounting sections 29 and 30 together in the direction of the rivets, but the ridge 34 and channel 32 interferingly engage to provide the primary torsional strength to the fixed joint 31, as described below. An enlarged clearance hole 68A (FIG. 2) is formed in the mounting section 30. A protrusion 69 on rack 62 is shaped to fit through hole 68, with the enlarged hole 68A providing access to peen over (i.e. the stake) the protrusion 69 to retain the rack 62 to the pre-assembled pedal construction 27/28.

The ridge 34 (FIG. 6) is slightly wider than the channel 32, and it includes the sharp edges 33. When the ridge 34 is pressed against and into the channel 32, the sharp edges 33 shave the marginal material 35 from the sides of the channel 32, causing the marginal material 35 to be shaved off and curl away in directions 73. The ridge 34 is about the same depth as the channel 32, such that when fully seated, a top of the ridge 34 presses the shaved marginal material 35A into the depressions 37. By this arrangement, the ridge 34 is consistently interferingly interlocked with the channel 32 with high torsional strength, even with normal manufacturing dimensional variations. The rivets 38 hold the fixed joint 31 together, but it is primarily the channel 32 and ridge 34 inter-fit that provides the torsional resistance to the joint 31. It has been found that by using the present arrangement, a very high-strength joint can be consistently constructed. Further, optimal and dissimilar materials and manufacturing processes can be used for the pedal lever 27, the lever mount 28, and the upper pedal member 25, while maintaining the needed functional strength required for a vehicle brake pedal assembly. For example, the illustrated brake pedal assembly can withstand over 200 pounds force on the footpad 63.

In the foregoing description, those skilled in the art will readily appreciate that modifications may be made to the invention without departing from the concepts disclosed herein. Such modifications are to be considered as included in the following claims, unless these claims by their language expressly state otherwise.

The invention claimed includes:

1. An article comprising:

a foot pedal lever and a lever mount including abutting mounting sections forming a fixed joint, one section having a channel and the other section having a ridge interference fit into the channel, one of the ridge and channel having sharp edges that shave marginal material from sides of the other of the ridge and channel when the ridge is forced into the channel, but at least one of the mounting sections having depressions located on the sides and positioned to receive the shaved marginal material when the ridge is forced into the channel so that the ridge can be fully seated in the channel; and at least one fastener holding the ridge in the channel, with the ridge and channel defining a plane and forming a primary mechanical structure providing torsional strength in the plane.

2. The article defined in claim 1, wherein the at least one fastener includes a mechanical fastener having a shaft that extends through the ridge and the channel.

3. The article defined in claim 1, wherein a top of the ridge is positioned closely adjacent a bottom of the channel when assembled.

4. The article defined in claim 1, including a lever support, and including an adjustment device operably connected between the lever support and the lever mount for adjustably supporting the lever mount on the lever support.

5. The article defined in claim 1, wherein the at least one fastener includes a mechanical fastener extended through the channel of the abutting mounting sections.

6. The article defined in claim 5, wherein the mechanical fastener includes a rivet.

7. The article defined in claim 1, wherein the abutting mounting sections include flat surfaces that abuttingly engage and from which the channel and the ridge extend.

8. The article defined in claim 1, wherein the pedal lever includes a footpad attached to the pedal lever at an end opposite the mounting section of the pedal lever.

9. The article defined in claim 1, wherein the lever mount includes elongated flanges, molded or otherwise adapted to form a linear bearing.

10. The article defined in claim 1, including a lever support and an adjustment mechanism slidably supporting the lever mount on the lever support.

11. The article defined in claim 1, wherein the channel and ridge are both at least about 2 times as long as wide.

12. An article comprising:

a foot pedal lever and a lever mount including abutting mounting sections forming a fixed joint, one section having a channel and the other section having a ridge interference fit into the channel, one of the ridge and channel having sharp edges that shave marginal material from sides of the other of the ridge and channel when the ridge is forced into the channel, but at least one of the mounting sections having depressions positioned to receive the shaved marginal material when the ridge is forced into the channel so that the ridge can be frilly seated in the channel; and at least one fastener holding the ridge in the channel, with the ridge and channel defining a plane and forming a primary mechanical structure providing torsional strength in the plane, wherein the at least one fastener includes at least three mechanical fasteners spaced apart in a non-linear arrangement and further includes a mechanical fastener extended through the abutting mounting sections.

13. An article comprising:

a foot pedal lever and a lever mount including abutting mounting sections forming a fixed joint, one section having a channel and the other section having a ridge interference fit into the channel, one of the ridge and channel having sharp edges that shave marginal material from sides of the other of the ridge and channel when the ridge is forced into the channel, but at least one of the mounting sections having depressions positioned to receive the shaved marginal material when the ridge is forced into the channel so that the ridge can be fully seated in the channel; and at least one fastener holding the ridge in the channel, with the ridge and channel defining a plane and forming a primary mechanical structure providing torsional strength in the plane, wherein the channel is formed on the mounting section of the pedal lever.

14. An article comprising:

a foot pedal lever and a lever mount including abutting mounting sections forming a fixed joint, one section having a channel and the other section having a ridge interference fit into the channel, one of the ridge and channel having sharp edges that shave marginal material from sides of the other of the ridge and channel when the ridge is forced into the channel, but at least one of the mounting sections having depressions positioned to receive the shaved marginal material when the ridge is forced into the channel so that the ridge can be fully seated in the channel;

at least one fastener holding the ridge in the channel, with the ridge and channel defining a plane and forming a primary mechanical structure providing torsional strength in the plane, wherein the lever mount includes elongated flanges, molded or otherwise adapted to form a linear bearing; and a lever support defining a track shaped to linearly engage the elongated flanges to form a linearly adjustable bearing.

15. The article defined in claim 14, including a rack attached to the lever mount adjacent the elongated flanges.

16. An article comprising:

a foot pedal lever and a lever mount including abutting mounting sections forming a fixed joint, one section having a channel and the other section having a ridge interference fit into the channel, one of the ridge and channel having sharp edges that shave marginal material from sides of the other of the ridge and channel when the ridge is forced into the channel, but at least one of the mounting sections having depressions positioned to receive the shaved marginal material when the ridge is forced into the channel so that the ridge can be fully seated in the channel; and at least one fastener holding the ridge in the channel, with the ridge and channel defining a plane and forming a primary mechanical structure providing torsional strength in the plane, wherein the depressions are elongated recesses, and wherein the one section having the ridge includes the elongated recesses on areas adjacent side surfaces of the ridge, with the recesses extending parallel the ridge.

17. A torsionally strong joint for connecting a lever and a lever mount, the lever and the lever mount including abutting mounting sections, the joint comprising:

one mounting section having a channel and the other mounting section having a ridge interference fit into the channel, one of the channel and the ridge having sharp edges that shave marginal material from sides of the other of the channel and the ridge when the ridge is forced into the channel, but the one of the channel and the ridge also having depressions located on the sides and positioned to receive the shaved marginal material when the ridge is forced into the channel; and at least one fastener holding the ridge in the channel, with the ridge and channel defining a plane and forming a primary mechanical structure providing torsional strength to the joint in the plane.

18. The article defined in claim 17, wherein the at least one fastener includes a mechanical fastener with a shaft that extends through the ridge and the channel.

19. The article defined in claim 17, wherein a top of the ridge is positioned closely adjacent a bottom of the channel when assembled.

20. The article defined in claim 17, including a lever support and an adjustment device operably connected between the lever support and the lever mount for adjustably supporting the lever mount on the lever support.

21. The article defined in claim 17, wherein the at least one fastener includes a mechanical fastener extended through the abutting mounting sections.

22. The article defined in claim 17, wherein the abutting mounting sections include flat surfaces that engage and from which the channel and the ridge are extended.

23. A torsionally strong joint for connecting a lever and a lever mount, the lever and the lever mount including abutting mounting sections, the joint comprising:

one mounting section having a channel and the other mounting section having a ridge interference fit into the channel, one of the channel and the ridge having sharp edges that shave marginal material from sides of the other of the channel and the ridge when the ridge is forced into the channel, but the one of the channel and the ridge also having depressions positioned to receive the shaved marginal material when the ridge is forced into the channel; and at least one fastener holding the ridge in the channel, with the ridge and channel defining a plane and forming a primary mechanical structure providing torsional strength to the joint in the plane, wherein the channel is formed on the mounting section of the pedal lever.

24. The article defined in claim 23, including a lever support defining a track shaped to linearly adjustably engage a mating structure on the lever mount.

25. The article defined in claim 24, including a rack attached to the follower.

26. A torsionally strong joint for connecting a lever and a lever mount, the lever and the lever mount including abutting mounting sections, the joint comprising:

one mounting section having a channel and the other mounting section having a ridge interference fit into the channel, one of the channel and the ridge having sharp edges that shave marginal material from sides of the other of the channel and the ridge when the ridge is forced into the channel, but the one of the channel and the ridge also having depressions positioned to receive the shaved marginal material when the ridge is forced into the channel; and at least one fastener holding the ridge in the channel, with the ridge and channel defining a plane and forming a primary mechanical structure providing torsional strength to the joint in the plane, wherein the depressions include elongated recesses, and wherein the one section having the ridge includes the elongated recesses on areas adjacent side surfaces of the ridge, with the recesses extending parallel the ridge.

27. A pedal apparatus comprising:

a support;

a pedal subassembly including an upper pedal member pivoted to the support, a lower pedal member; and an adjustment device adjustably supporting the lower pedal member on the upper pedal member for translational adjustment;

the lower pedal member including a pedal lever and a lever mount with abutting mounting sections forming a torsionally-strong fixed joint, the mounting section of the pedal lever having a channel and the mounting section of the lever mount having a ridge interference fit into the channel; one of the ridge and channel having depressions located on sides thereof for receiving shaved marginal material from the other of the ridge and channel; and at least one fastener extending through and holding the ridge in the channel with the ridge and channel defining a plane and forming a primary mechanical structure providing torsional strength to the joint in the plane.

28. The pedal apparatus defined in claim 27, wherein one of the channel and the ridge have sharp edges that shave marginal material from sides of the other channel and the ridge when the ridge is forced into the channel, but the other of the channel and the ridge having depressions positioned to receive the shaved marginal material when the ridge is forced into the channel.

* * * * *